US012369693B1

(12) United States Patent
Zhang

(10) Patent No.: US 12,369,693 B1
(45) Date of Patent: Jul. 29, 2025

(54) TENSIONER WITH RETRACTABLE HANDLE

(71) Applicant: Zhangjiagang SMK MFG. Co., Ltd., Zhangjiagang (CN)

(72) Inventor: Jinhui Zhang, Zhangjiagang (CN)

(73) Assignee: Zhangjiagang SMK MFG. Co., Ltd., Zhangjiagang (CN)

( * ) Notice: Subject to any disclaimer, the term of this patent is extended or adjusted under 35 U.S.C. 154(b) by 0 days.

(21) Appl. No.: 19/002,846

(22) Filed: Dec. 27, 2024

(30) Foreign Application Priority Data

Dec. 6, 2024 (CN) ..... 202423005127.0

(51) Int. Cl.
*B25B 25/00* (2006.01)
*A44B 11/06* (2006.01)

(52) U.S. Cl.
CPC ..... *A44B 11/065* (2013.01); *Y10T 24/2121* (2015.01)

(58) Field of Classification Search
CPC ..... B60P 7/0823; B60P 7/083; Y10T 24/21; Y10T 24/2175; Y10T 24/2121; A44B 11/065
See application file for complete search history.

(56) References Cited

U.S. PATENT DOCUMENTS 5,205,020 A * 4/1993 Kamper ..... F16G 11/12 24/68 CD
5,282,706 A * 2/1994 Anthony ..... B60P 3/10 410/97
5,894,638 A * 4/1999 Huang ..... B60P 7/083 24/68 CD
6,007,053 A * 12/1999 Huang ..... B60P 7/083 254/223
7,444,718 B1 * 11/2008 Chang ..... B60P 7/083 24/68 CD
8,209,821 B1 * 7/2012 Chen ..... B60P 7/083 24/69 ST
9,751,450 B1 * 9/2017 Zhou ..... B60P 7/083
10,836,300 B2 * 11/2020 Persson ..... A61G 3/08
2003/0146424 A1 * 8/2003 Lee ..... B60P 7/083 254/237
2011/0179609 A1 * 7/2011 Huang ..... B60P 7/083 24/68 CD
2012/0073097 A1 * 3/2012 Chang ..... B60P 7/083 24/68 CD (Continued)

*Primary Examiner* — Jason W San
*Assistant Examiner* — Michael S Lee
(74) *Attorney, Agent, or Firm* — JEEN IP LAW, LLC

(57) ABSTRACT

A tensioner with retractable handle is provided, including a sheet metal base and a sheet metal handle. The sheet metal base is provided with a centre shaft in the middle thereon, the sheet metal handle includes a tightening part and a handle. A bottom of the tightening part is rotatably connected to the middle of the sheet metal base, an inner side of the tightening part is slidably connected with an upper baffle, and a bottom of the upper baffle is connected with two lower tongue parts. A rear end of the sheet metal base is provided with a lower baffle and a lower connecting plate, and the lower connecting plate is interlocked with the lower baffle. An inner side of a front of the sheet metal base is connected with a spring retaining plate, which is used to stop the gear from reversing and prevent the webbing from retracting.

6 Claims, 6 Drawing Sheets

(56) References Cited

U.S. PATENT DOCUMENTS

2012/0205601 A1* 8/2012 Joubert ..... B60P 7/0846
254/217
2015/0151664 A1* 6/2015 Chang ..... B60P 7/083
24/70 CT

* cited by examiner

TENSIONER WITH RETRACTABLE HANDLE

CROSS REFERENCE TO RELATED APPLICATION

This application claims priority to Chinese Patent Application No. 202423005127.0, filed on Dec. 6, 2024, which is hereby incorporated by reference in its entirety.

TECHNICAL FIELD

The present application relates to the technical field of tensioners, and specifically to a tensioner with retractable handle.

BACKGROUND

Most of existing tensioners are separated from the webbing. When in use, the longer webbing needs to be tied to the goods, two ends of the webbing are fixed by the tensioner, and the webbing is further tightened by engagement of the tensioner, thereby achieving the effect of further tying the goods.

However, the existing technologies also have the following problems. On the one hand, the webbing and the tensioner are separated, which has low portability and requires the webbing to be completely opened during use. Due to different lengths of webbing used for different goods, there is still a part of the webbing that needs to be tied and fixed after tying the goods, which reduces safety. On the other hand, the webbing still needs to be recycled after use, and such operation is very complicated. Therefore, the present disclosure proposes a tensioner with retractable handle to solve the problems discussed above.

SUMMARY

The present disclosure aims to provide a tensioner with retractable handle to address the problems raised in the background.

To achieve above objectives, the present disclosure adopts the following technical solutions.

In some embodiments of the present disclosure, a tensioner with retractable handle is provided, including a sheet metal base, a sheet metal handle, an upper baffle, a lower baffle, a lower connecting plate, and a spring retaining plate.

Herein a centre shaft is installed in a middle of the sheet metal base.

Herein the sheet metal handle includes a tightening part and a handle. A bottom of the tightening part is rotatably connected to the middle of the sheet metal base through the centre shaft, and a top of the tightening part is fixedly connected to a bottom of the handle.

Herein both ends of the upper baffle are slidably connected to both sides of an upper part of the tightening part, and a bottom of the upper baffle is symmetrically connected with two downward lower tongue parts.

Herein both sides of the lower baffle are slidably connected to both sides of a rear end of the sheet metal base.

Herein a bottom of the lower connecting plate is rotatably connected to the both sides of the rear end of the sheet metal base, and the lower connecting plate is interlocked with the lower baffle.

Herein a bottom of the spring retaining plate is rotatably connected to both sides of a front end of the sheet metal base.

In some preferred embodiments of the present disclosure, an extending part is connected to one end of the upper baffle near the handle, and a first spring is sleeved on the extending part. Moreover, a connecting piece is connected to an inner side of one end of the handle near the tightening part, the extending part is inserted into the connecting piece for engagement, and one end of the first spring is abutted with the connecting piece.

In some preferred embodiments of the present disclosure, a first hole is provided in a middle of the lower baffle, one end of a second spring is installed inside the first hole, and another end of the second spring is connected to a side of the sheet metal base.

In some preferred embodiments of the present disclosure, a second hole is provided in a rear of the lower baffle, a top front of the lower connecting plate is connected to a front standing plate matching with the second hole, and a top rear of the lower connecting plate is connected to an upper tongue part interacted with the lower tongue parts.

In some preferred embodiments of the present disclosure, a winder is provided on an outer wall of the bottom of the tightening part, a gear is provided in a middle of the centre shaft, and an interior of the winder is connected to the centre shaft by means of a coil spring.

In some preferred embodiments of the present disclosure, an intermediate plate is connected to a top middle of the spring retaining plate, and side plates are connected to top two sides of the spring retaining plate.

In some preferred embodiments of the present disclosure, the front end of the sheet metal base is provided with a protective cover, and the spring retaining plated is provided in an inner side of the protective cover.

The tensioner with retractable handle of the present disclosure has at least the following beneficial effects.

1. The tensioner is combined with the webbing, and when in use, only an appropriate amount of the webbing needs to be pulled out of the tensioner. By fixing the head and tail with hooks on the webbing, the tensioner can be secured without producing excess webbing, avoiding the safety hazard of the webbing being loosened.

2. The opening and closing angles of the sheet metal handle is large enough, and the length of the webbing being reciprocating tightened each time is longer, which is convenient for tightening with force and has high practicality. Moreover, the lower baffle is set at the rear of the sheet metal base, and the bottom of the lower connecting plate is rotatably connected to the sheet metal base, forming a lever structure through the lower connecting plate, which can facilitate better resetting and detaching of the lower baffle, and has high stability in use.

Figure 1:
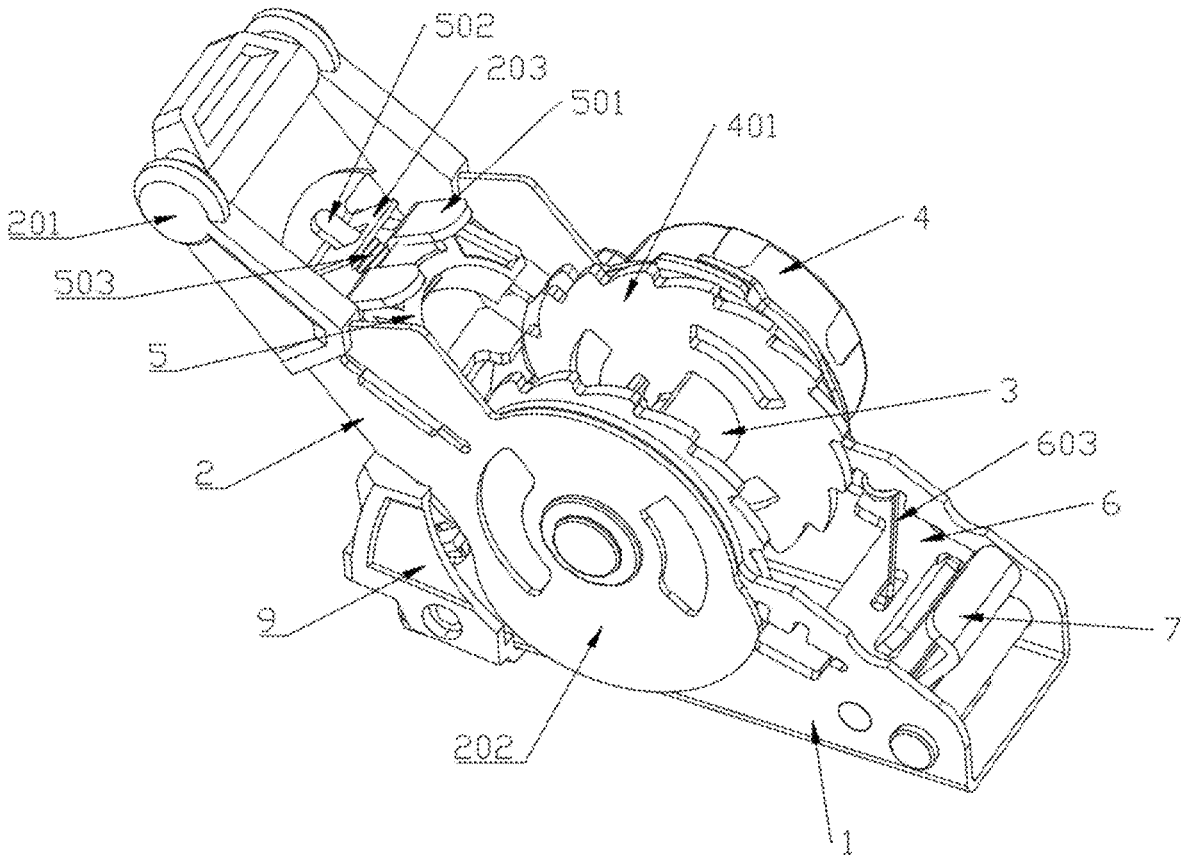
FIG. 1 shows a schematic diagram of an overall external structure of a tensioner with retractable handle in accordance with some embodiments of the present disclosure.

In the drawings, reference signs are as follows. 1. Sheet metal base, 2. Sheet metal handle, 201. Handle, 202. Tightening part, 203. Connecting piece, 3. Centre shaft, 4. Winder, 401. Gear, 5. Upper baffle, 501. Lower tongue part, 502. Extending part, 503. First spring, 6. Lower baffle, 601. First hole, 602. Second hole, 603. Second spring, 7. Lower connecting plate, 701. Front standing plate, 702. Upper tongue part, 8. Spring retaining plate, 801. Intermediate plate, 802. Side plate, 9. Protective cover. 402. Coil spring.

DETAILED DESCRIPTION OF THE EMBODIMENTS

The following will provide a further detailed explanation of the technical solutions of the tensioner with retractable handle of the present disclosure in conjunction with specific embodiments.

Figure 6:
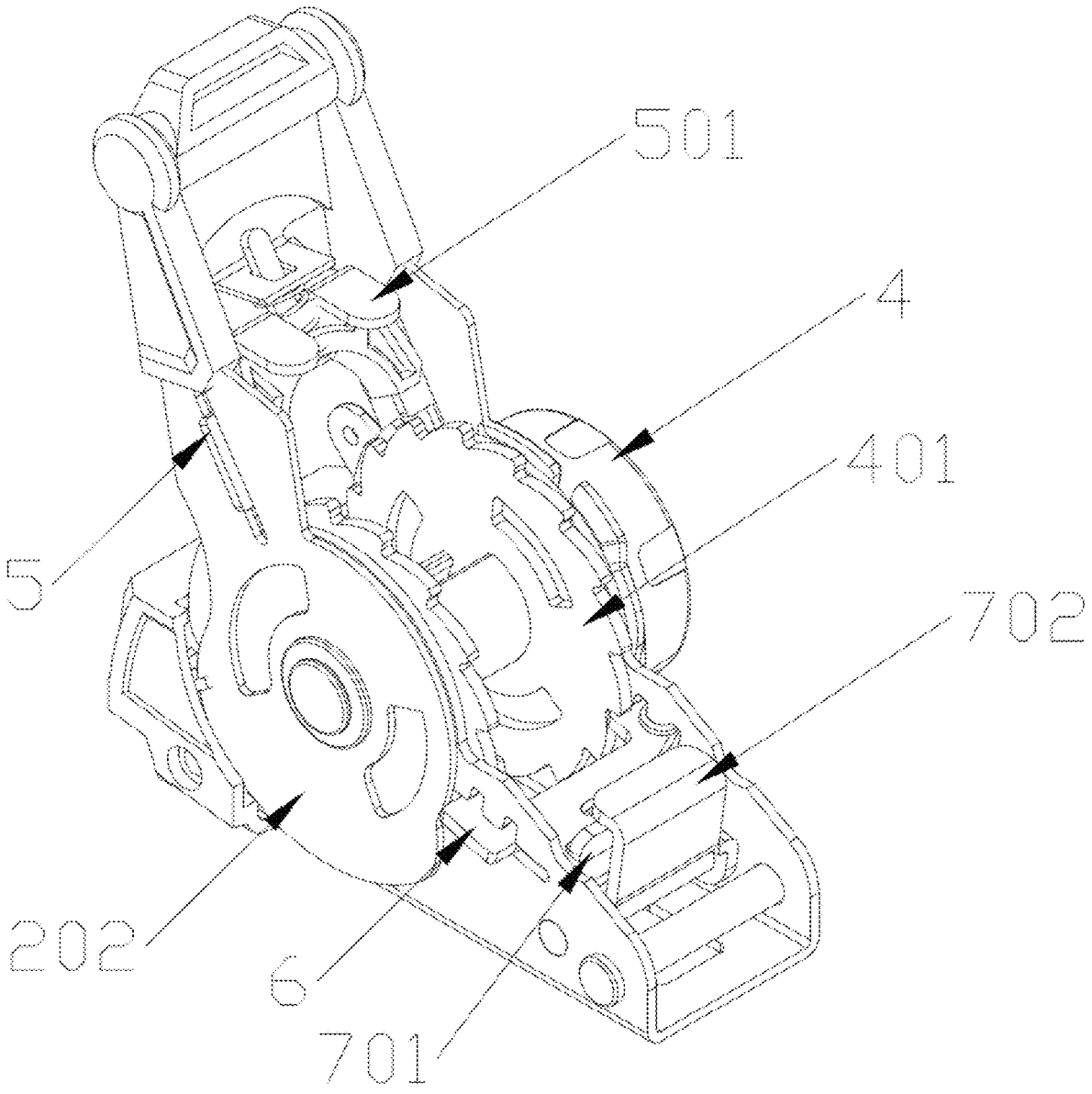
FIG. 6 shows another schematic diagram of the overall external structure of the tensioner with retractable handle in accordance with some embodiments of the present disclosure.

Referring to FIG. 1 and FIG. 6, in some embodiments of the present disclosure, a tensioner with retractable handle is provided, including a sheet metal base 1 and a sheet metal handle 2. Herein the sheet metal base 1 is provided with a centre shaft installed in the middle thereon, the sheet metal handle 2 includes a tightening part 202 and a handle 201. A bottom of the tightening part 202 is rotatably connected to the middle of the sheet metal base 1 through the centre shaft 3, and a top of the tightening part 202 is fixedly connected to a bottom of the handle 201. An upper baffle 5 is movably connected to an inner side of the tightening part 202, both side ends of the upper baffle 5 are slidably connected to both sides of an upper part of the tightening part 202, and a bottom of the upper baffle 5 is symmetrically connected with two downward lower tongue parts 501. The inner side of the rear end of the sheet metal base 1 is movably connected with a lower baffle 6 and a lower connecting plate 7, both sides of the lower baffle 6 are slidably connected to both sides of the rear end of the sheet metal base 1, a bottom of the lower connecting plate 7 is rotatably connected to the both sides of the rear end of the sheet metal base 1, and the lower connecting plate 1 is interlocked with the lower baffle 6. A spring retaining plate 8 is movably connected to the inner side of a front end of the sheet metal base 1, and a bottom of the spring retaining plate 8 is rotatably connected to both sides of the front end of the sheet metal base 1.

Referring to FIG. 1, an extending part 502 is connected to one end of the upper baffle 5 near the handle 201, and a first spring 503 is sleeved on the extending part 502. A connecting piece 203 is connected to an inner side of one end of the handle 201 near the tightening part 202, the extending part 502 is inserted into the connecting piece 203 for engagement, and one end of the first spring 503 is abutted with the connecting piece 203.

Referring to FIG. 1 to FIG. 6, a first hole 601 is provided in a middle of the lower baffle 6, one end of a second spring 603 is installed inside the first hole 601, and another end of the second spring 603 is connected to a side of the sheet metal base 1. A second hole 602 is provided in a rear of the lower baffle 6, a top front of the lower connecting plate 7 is connected to a front standing plate 701 matching with the second hole 602, and a top rear of the lower connecting plate 7 is connected to an upper tongue part 702 interacted with the lower tongue parts 501.

Figure 2:
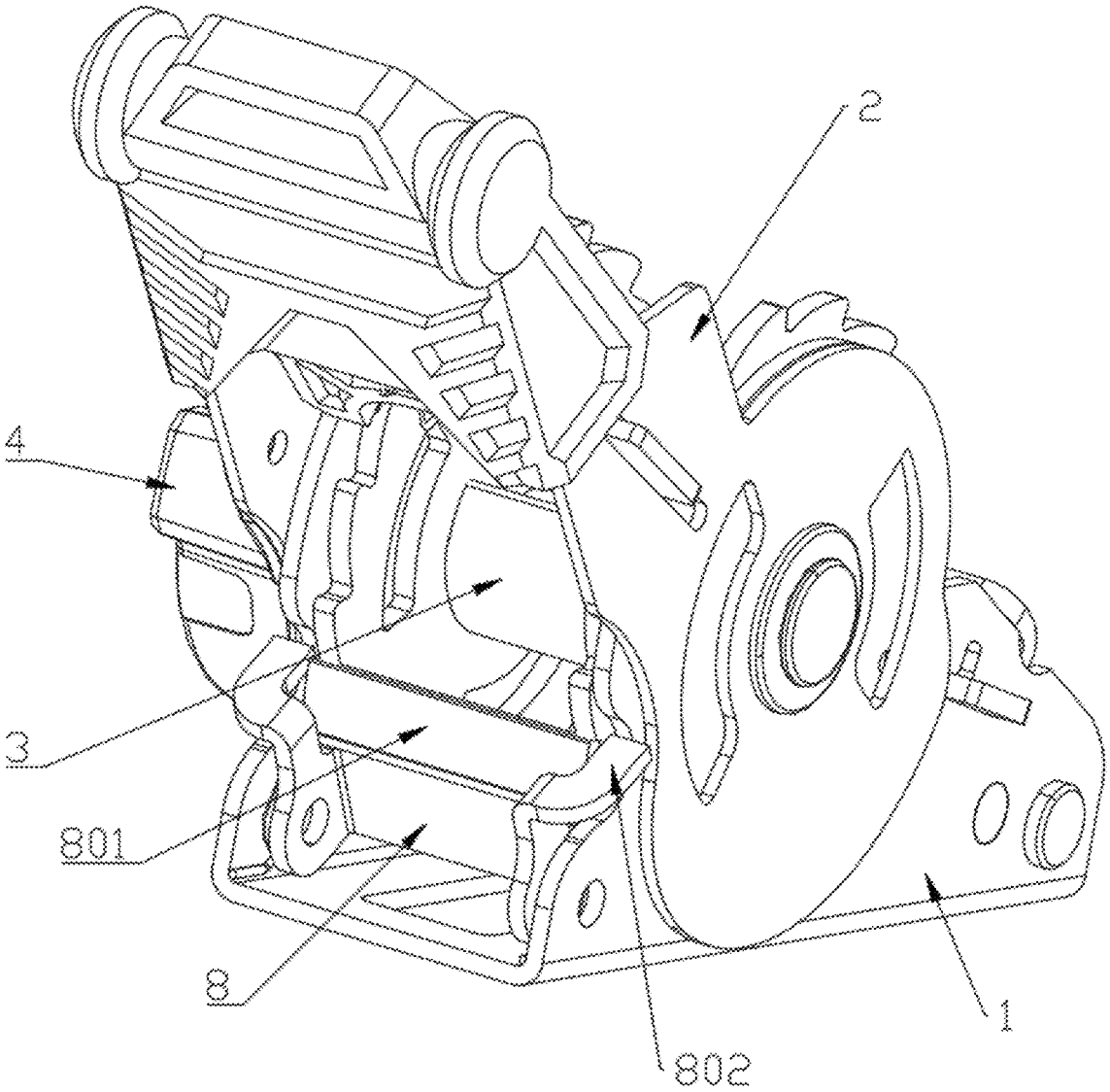
FIG. 2 shows a schematic diagram of an assembled structure of a spring retaining plate and a sheet metal base in accordance with some embodiments of the present disclosure.
Figure 3:
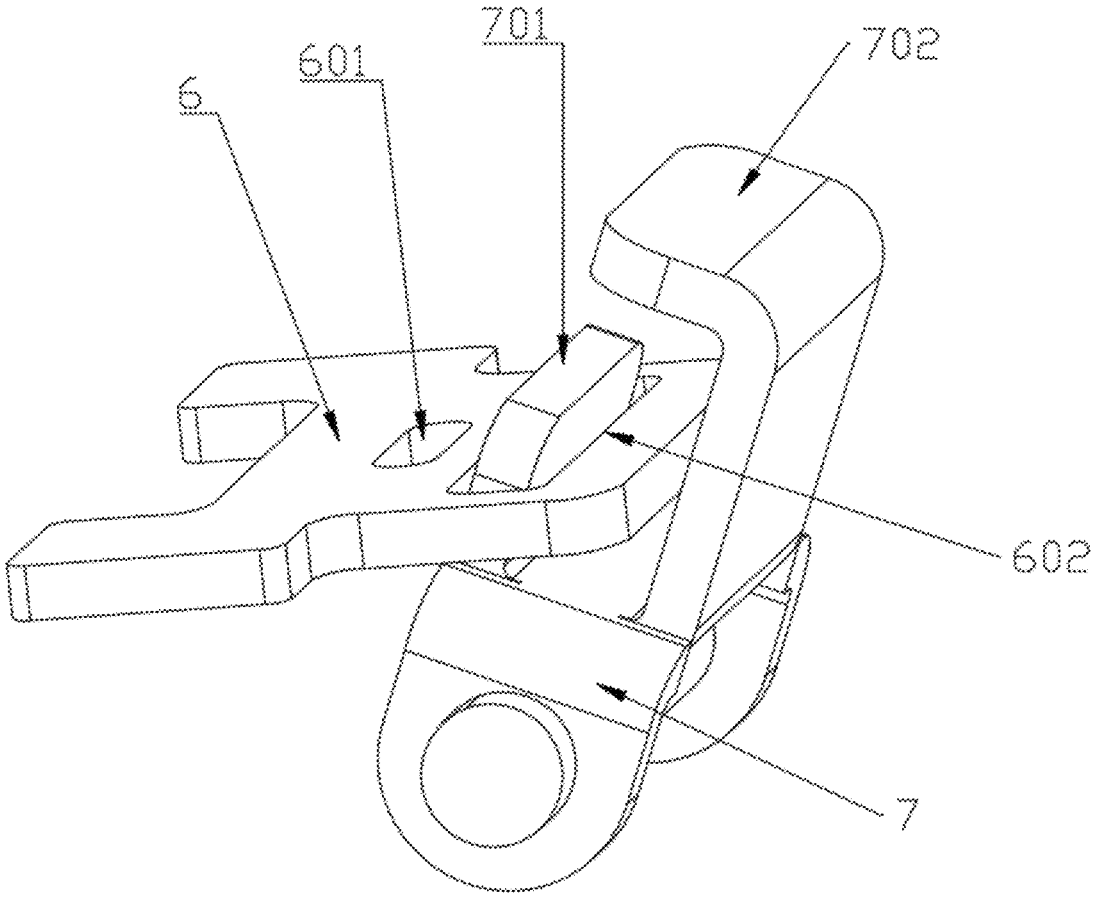
FIG. 3 shows a schematic diagram of an assembled structure of a lower connecting plate and a lower baffle in accordance with some embodiments of the present disclosure.
Figure 5:
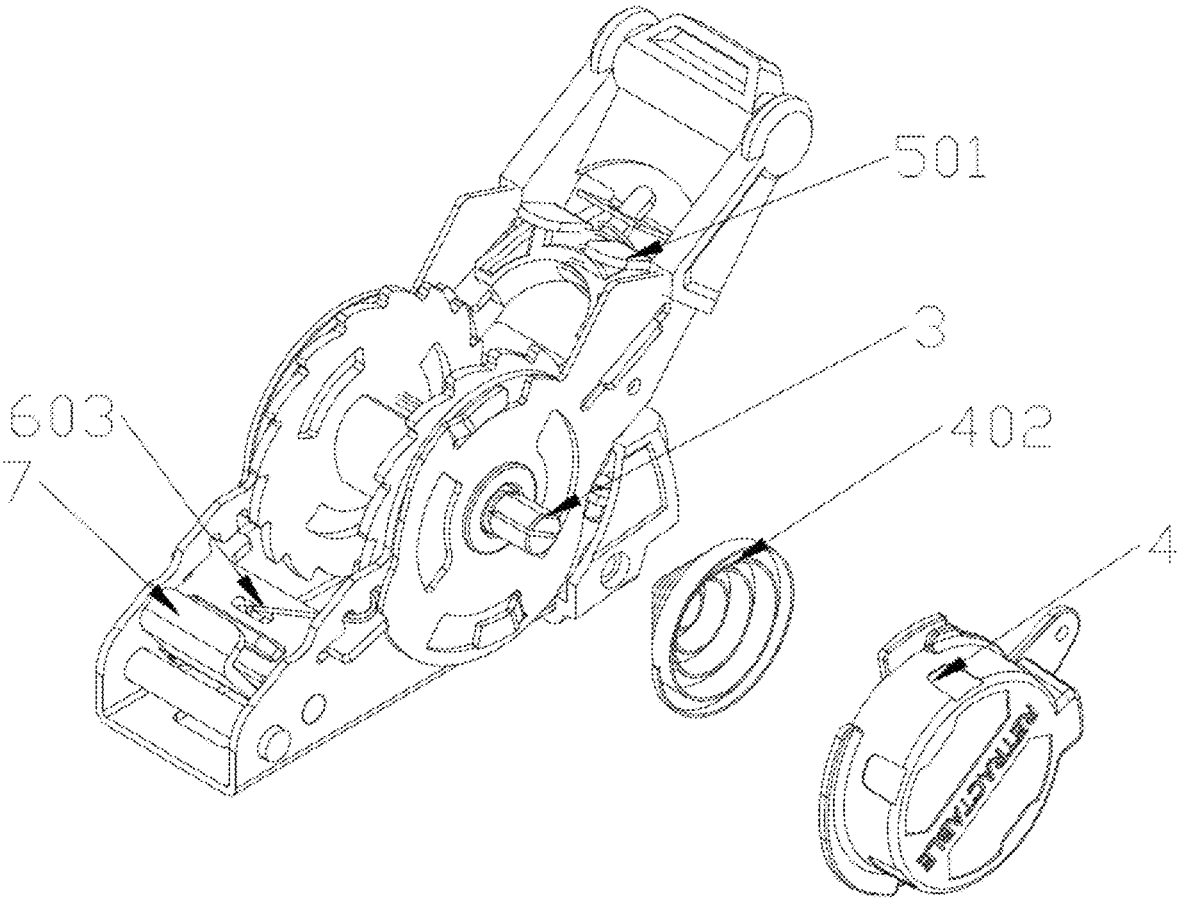
FIG. 5 shows a schematic split structural diagram of the tensioner with retractable handle of the present disclosure.

In some other embodiments of the present disclosure, referring to FIG. 1 and FIG. 2, on the basis of the structure described above, a winder 4 is provided on an outer wall of the bottom of the tightening part 202, a gear 401 is provided in a middle of the centre shaft 3, and an interior of the winder 4 is connected to the centre shaft 3 by means of a coil spring 402 (shown in FIG. 5). The spring retaining plate 8 can stop the gear 401 from reversing during operation, preventing the webbing from retracting.

Figure 4:
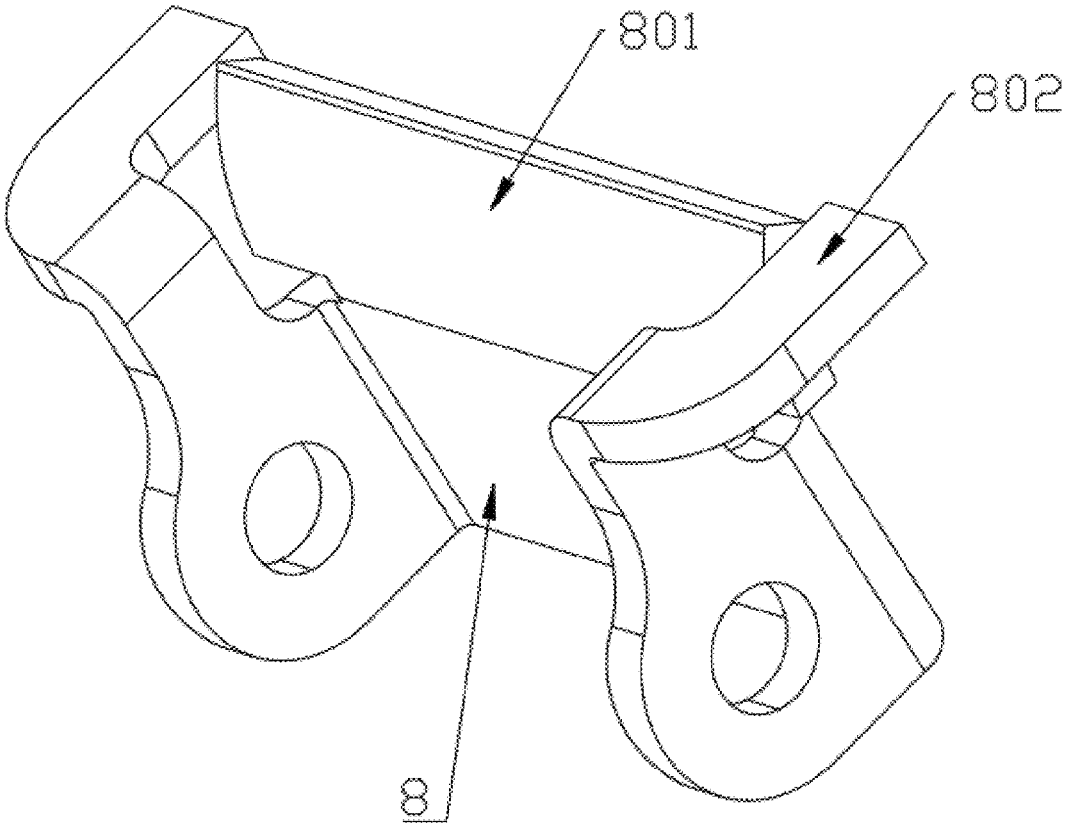
FIG. 4 shows a structural schematic diagram of a spring retaining plate in accordance with some embodiments of the present disclosure.

Referring to FIG. 1, FIG. 2, and FIG. 4, an intermediate plate 801 is connected to a top middle of the spring retaining plate 8, and side plates 802 are connected to top two sides of the spring retaining plate 8. The intermediate plate 801 and the side plates 802 are used to limit the gear 401 and the handle 201, respectively. The front end of the sheet metal base 1 is provided with a protective cover 9, and the spring retaining plated 8 is provided in an inner side of the protective cover 9.

The operating principle of the tensioner with retractable handle of the present disclosure is described as follows. When the upper baffle 5 is pulled up, the sheet metal handle 2 can be opened to the maximum engagement state. After releasing the upper baffle 5, the upper baffle 5 no longer engages with the gear 401. Similarly, the lower baffle 6 is lifted by the outer contour of the sheet metal handle 2, and the lower baffle 6 no longer engages with the gear 401. At this time, the side plates 802 of the spring retaining plate 8 is abutted with the groove on the handle 201, and the intermediate plate 801 is engaged with a portion of the teeth of the gear 401 and used to stop the gear 401 from reversing. When manually pulling out the webbing, the webbing can be pulled out normally. When released, the gear 401 is stopped by the action of the spring retaining plate 8, and the gear 401 cannot retract, thereby achieving the stopping of the webbing and facilitating single-hand pulling. When the sheet metal handle 2 is fully closed, the side plates 802 of the spring retaining plate 8 is lifted up by the outer contour of the sheet metal handle 2, causing the intermediate plate 801 to detach from the gear 401 and do not stop the gear anymore. At this time, the upper baffle 5 and the lower baffle 6 are in a closed state, and the upper baffle 5 and the lower baffle 6 are stuck in the gear 401, which is in a stuck state. In this way, the tensioner is stuck, and the webbing cannot be pulled out. When the sheet metal handle 2 is not moved, the webbing cannot be tightened either. When retracting the webbing, the upper baffle 5 is pulled up to drive the lower connecting plate 7 to move. Then the lower connecting plate 7 hooks the lower baffle 6 and rollbacks, causing the upper baffle 5 and the lower baffle 6 to disengage from the gear 401. The webbing loses the engagement between the upper baffle 5 and the lower baffle 6, the elastic action of the coil spring 402 drives the webbing to roll back, and the sheet metal handle 2 is opened by continuously pulling back for closure to continuously tighten the gear 401, thereby achieving the tightening of the webbing. When tightening the webbing, the upper baffle 5 always have the suck state with the gear to prevent the webbing from loosening and failing to tighten.

For one of ordinary skill in the art, it is apparent that the present disclosure is not limited to the details of the exemplary embodiments described above, and can be implemented in other specific forms without departing from the concept or basic features of the present disclosure. Therefore, from any point of view, the embodiments should be regarded as exemplary and non-limiting, and the scope of the present disclosure is limited by the appended claims rather than the above description. Accordingly, it is intended to include all changes falling within the meaning and scope of the equivalent elements of the claims in the present disclosure. Any reference signs in the claims shall not be regarded as limiting the claims involved.

In addition, it should be understood that although this specification is described according to the embodiments, not each embodiment only contains one independent technical solution. This description of the specification is only for clarity, and the one of ordinary skill in the art should consider the specification as a whole. The technical solutions in each embodiment can also be appropriately combined to form other embodiments that are understandable to one of ordinary skill in the art.

What is claimed is:

1. A tensioner with retractable handle, comprising:

a sheet metal base, provided with a centre shaft installed in a middle of the sheet metal base;

a sheet metal handle, comprising a tightening part and a handle, wherein a bottom of the tightening part is rotatably connected to the middle of the sheet metal base through the centre shaft, and a top of the tightening part is fixedly connected to a bottom of the handle;

an upper baffle, wherein both side ends of the upper baffle are slidably connected to both sides of an upper part of the tightening part, and a bottom of the upper baffle is symmetrically connected with two downward lower tongue parts;

a lower baffle, wherein both sides of the lower baffle are slidably connected to both sides of a rear end of the sheet metal base;

a lower connecting plate, wherein a bottom of the lower connecting plate is rotatably connected to the both sides of the rear end of the sheet metal base, and the lower connecting plate is interlocked with the lower baffle; and a spring retaining plate, wherein a bottom of the spring retaining plate is rotatably connected to both sides of a front end of the sheet metal base;

wherein a second hole is provided in a rear of the lower baffle, a top front of the lower connecting plate is connected to a front standing plate matching with the second hole, and a top rear of the lower connecting plate is connected to an upper tongue part.

2. The tensioner with retractable handle according to claim 1, wherein an extending part is connected to one end of the upper baffle near the handle, and a first spring is sleeved on the extending part; and wherein a connecting piece is connected to an inner side of one end of the handle near the tightening part, the extending part is inserted into the connecting piece for engagement, and one end of the first spring is abutted with the connecting piece.

3. The tensioner with retractable handle according to claim 1, wherein a first hole is provided in a middle of the lower baffle, one end of a second spring is installed inside the first hole, and another end of the second spring is connected to a side of the sheet metal base.

4. The tensioner with retractable handle according to claim 1, wherein a winder is provided on an outer wall of the bottom of the tightening part, a gear is provided in a middle of the centre shaft, and an interior of the winder is connected to the centre shaft by means of a coil spring.

5. The tensioner with retractable handle according to claim 1, wherein an intermediate plate is connected to a top middle of the spring retaining plate, and side plates are connected to top two sides of the spring retaining plate.

6. The tensioner with retractable handle according to claim 5, wherein the front end of the sheet metal base is provided with a protective cover, and the spring retaining plated is provided in an inner side of the protective cover.

* * * * *